United States Patent [19]

Liang

[11] 4,407,632

[45] Oct. 4, 1983

[54] AIRFOIL PEDESTALED TRAILING EDGE REGION COOLING CONFIGURATION

[75] Inventor: George P. Liang, Jupiter, Fla.

[73] Assignee: United Technologies Corporation, Hartford, Conn.

[21] Appl. No.: 277,480

[22] Filed: Jun. 26, 1981

[51] Int. Cl.[3] ..... F01D 5/18

[52] U.S. Cl. ..... 416/97 R; 415/115

[58] Field of Search ..... 416/97 R, 96 A; 415/115

[56] References Cited

U.S. PATENT DOCUMENTS

| | | | |
|---|---|---|---|
| 3,554,663 | 1/1971 | Helms | 416/97 R |
| 3,606,572 | 9/1971 | Schwedland | 416/97 R X |
| 3,606,573 | 9/1971 | Emmerson et al. | 416/97 R X |
| 3,616,125 | 10/1971 | Bowling | 416/97 R |
| 3,628,885 | 12/1971 | Sidenstick et al. | 416/97 R |
| 3,688,833 | 9/1972 | Bykov et al. | 416/97 R UX |
| 3,819,295 | 6/1974 | Hauser et al. | 416/97 R |
| 3,846,041 | 11/1974 | Albani | 416/97 R |
| 3,994,622 | 11/1976 | Schultz et al. | 416/96 A X |
| 4,118,146 | 10/1978 | Dierberger | 415/115 X |
| 4,203,706 | 5/1980 | Hess | 415/115 X |
| 4,278,400 | 7/1981 | Yamarik et al. | 416/97 R |
| 4,297,077 | 10/1981 | Durgin et al. | 416/97 R |

FOREIGN PATENT DOCUMENTS

| | | | |
|---|---|---|---|
| 626461 | 8/1961 | Canada | 416/96 A |
| 32646 | 7/1981 | France | 415/115 |
| 872705 | 7/1961 | United Kingdom | 416/97 |
| 1427916 | 3/1976 | United Kingdom | 415/115 |
| 208173 | 6/1968 | U.S.S.R. | 416/97 R |
| 779590 | 11/1980 | U.S.S.R. | 416/97 R |

OTHER PUBLICATIONS

Gas Turbine Intl., Jul-Aug. vol. 18, No. 4, p. 51 "Detroit Diesel Allison's 570-K".

*Primary Examiner*—Philip R. Coe
*Assistant Examiner*—Frankie L. Stinson
*Attorney, Agent, or Firm*—Stephen E. Revis

[57] ABSTRACT

The trailing edge region of an airfoil includes a slot formed between the pressure and suction side walls with an array of pedestals extending across the slot, wherein selected pairs of pedestals are connected by a barrier wall adjacent either the pressure or suction side of the slot. The barrier walls extend inwardly toward the opposite side wall only partway across the slot to trip the thermal boundary layer of the cooling air flowing in the slot. These barrier walls alternate, in the downstream direction, between the pressure side and the suction side of the slot such that cooling air flowing downstream must move back and forth between the pressure and suction side walls in order to pass over these walls. Simultaneously, as the cooling air travels downstream, it snakes around the pedestals. The result is that the cooling air flows through the slot along a plurality of spiral or vortex-like flow paths resulting in improved heat transfer.

8 Claims, 5 Drawing Figures

AIRFOIL PEDESTALED TRAILING EDGE REGION COOLING CONFIGURATION

DESCRIPTION

1. Technical Field

This invention relates to airfoils, and more particularly to means for cooling the trailing edge region thereof.

2. Background Art

Airfoils constructed with cavities and passageways for carrying cooling fluid therethrough are well known in the art. For example, it is common to construct airfoils with spanwise cavities within the wider forward portion. These cavities often have inserts disposed therein which define compartments and the like within the cavities. The cooling fluid is brought into the cavities and compartments and some of the fluid is often ejected therefrom via holes in the airfoil walls to film cool the external surface of the airfoil. The trailing edge region of airfoils is generally more difficult to cool than other portions of the airfoil because the cooling air is hot when it arrives at the trailing edge since it has been used to cool other portions of the airfoil, and the relative thinness of the trailing edge region limits the rate at which cooling fluid can be passed through that region.

A common technique for cooling the trailing edge region is to pass cooling fluid from the larger cavity in the forward portion of the airfoil through the trailing edge region of the airfoil via a plurality of small diameter drilled passageways. Such an airfoil construction is shown in U.S. Pat No. 4,183,716. Another common technique for convectively cooling the trailing edge region is by forming a narrow slot between the walls in the trailing edge region and having the slot communicate with a cavity in the forward portion of the airfoil and with outlet means along the trailing edge of the airfoil. The slot carries the cooling fluid from the cavity to the outlets in the trailing edge. An array of pedestals extending across the slot from the pressure to the suction side wall are typically incorporated to create turbulence in the cooling air flow as it passes through the slot and to increase the convective cooling surface area of the airfoil. The rate of heat transfer is thereby increased, and the rate of cooling fluid flow required to be passed through the trailing edge region may be reduced. U.S. Patent Nos. 3,628,885; 3,819,295; and 3,994,622 are examples of airfoils constructed in this manner.

Another airfoil constructed with improved means for carrying cooling fluid from a cavity in the forward portion of the airfoil through the trailing region and out the trailing edge of the airfoil is shown in commonly owned U.S. Pat. No. 4,203,706. In that patent wavy criss-crossing grooves in opposing side walls of the trailing edge region provide tortuous paths for the cooling fluid through the trailing edge region and thereby improve heat transfer rates.

Despite the variety of trailing edge region cooling configurations described in the prior art, further improvement is always desirable in order to allow the use of higher operating temperatures, less exotic materials, and reduced cooling air flow rates through the airfoils, as well as to minimize manufacturing costs.

DISCLOSURE OF INVENTION

An object of the present invention is an airfoil having an improved convective cooling configuration in the trailing edge region.

According to the present invention an airfoil having a spanwise cooling air slot formed between the pressure and suction side walls of the trailing edge region for carrying coolant flow from a cavity in the forward portion of the airfoil to outlets in the trailing edge of the airfoil includes an array of pedestals extending across the slot with fluid barriers in the form of walls joining selected adjacent pedestals, the walls extending inwardly from either the pressure side wall to form pressure side fences or from the suction side wall to form suction side fences, the fence height being less than the slot width, the fences being arranged in a pattern alternating, in the downstream direction, between suction side fences and pressure side fences.

More specifically in the present invention the pedestals are arranged in parallel rows to form an array of predetermined configuration, which will be described in detail hereinbelow. The fences mentioned above are walls joining adjacent pedestals and extending inwardly from either the suction or pressure side wall, but only part way across the width of the slot. Thus, cooling fluid can still flow between pedestals joined by a fence, but must flow over the fence to do so. Each fence in the path of the cooling fluid is on the opposite inside surface of the slot from the preceding fence, and the cooling fluid must therefore continuously change directions to travel over the fences. Thus the present invention utilizes a pedestal and fence configuration which confronts the cooling fluid with, alternatively, a suction side fence and a pressure side fence, forcing the fluid to move back and forth between the pressure and suction side of the airfoil as it traverses the slot in the downstream direction. While moving back and forth over the fences, the cooling fluid must also move around the pedestals. This superimposes a third dimension motion on the fluid perpendicular to the back and forth motion, with the result that the fluid moves in a plurality of parallel spiral-like paths through the slot towards the trailing edge outlets.

The highly turbulent spiral flow created by this invention, coupled with the increased internal convective area provided by the fences, results in better heat transfer than that obtained from prior art pedestaled trailing edge region configurations. The configuration of the present invention has also been compared, by testing, to the wavy criss-cross configuration of U.S. Pat. No. 4,203,706. In contradistinction to the wavy criss-cross configuration wherein the rate of heat transfer per unit coolant flow decreases as coolant flow rate increases, with the present invention the rate of heat transfer per unit coolant flow increases rapidly as coolant flow rate increases (i.e., as Reynolds number increases). Furthermore, there is very little increase in pressure drop as coolant flow rates increase. Thus, the coolant configuration of the present invention is particularly useful for airfoils which have large heat loads and require larger coolant flow rates.

The foregoing and other objects, features and advantages of the present invention will become more apparent in the light of the following detailed description of the preferred embodiments thereof as shown in the accompanying drawing.

BEST MODE FOR CARRYING OUT THE INVENTION

Figure 1:
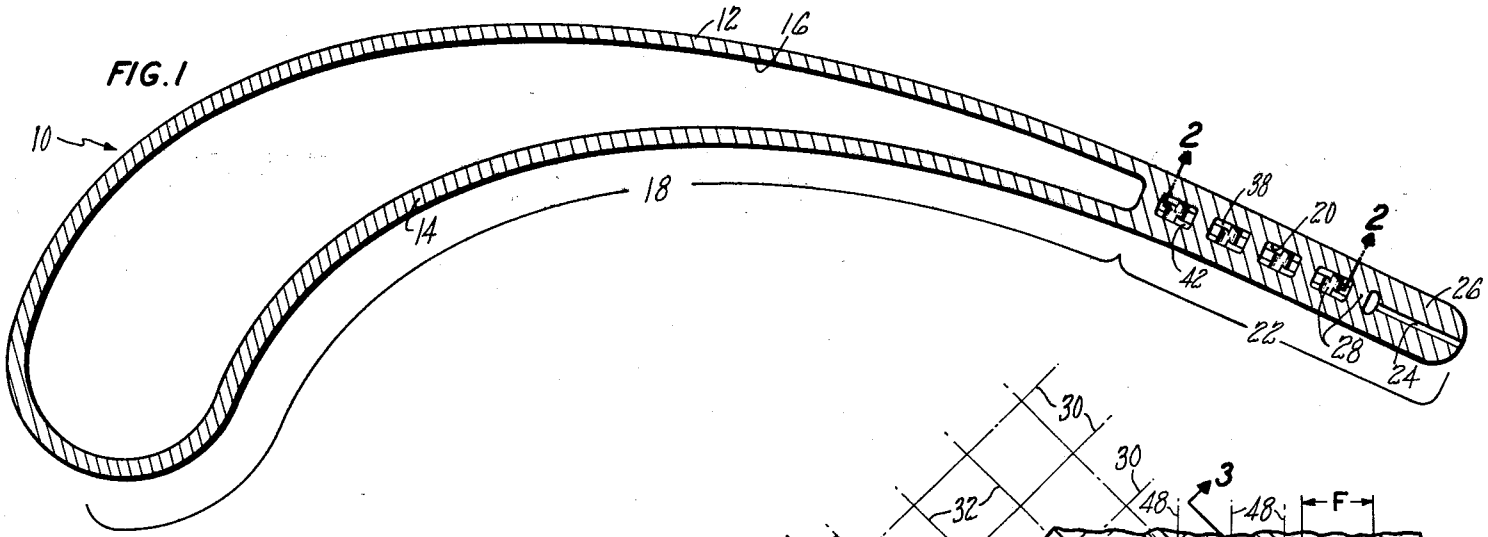
FIG. 1 is a cross-sectional view of an airfoil incorporating the features of the present invention.

As an exemplary embodiment of the present invention, consider the hollow airfoil generally represented by the numeral 10 in FIG. 1. The airfoil 10 comprises a suction side wall 12 and a pressure side wall 14. The pressure and suction side walls are spaced apart defining a spanwise cooling air cavity 16 in the forward portion 18 of the airfoil and a spanwise slot 20 in the trailing edge region 22. The airfoil 10 also includes a plurality of outlet passages 24 through the trailing edge 26. The slot 20 communicates with the cavity 16 for receiving cooling fluid therefrom and with the passages 24 for discharging the cooling fluid from the slot 20.

Since this embodiment is concerned with the cooling configuration in the trailing edge region 22, the configuration of the forward portion 18 of the airfoil is not critical except to the extent that it must have a cooling air cavity therein in communication with the slot 20. In this application the term "cavity" is used in its broadest sense to encompass any cooling air passageway, compartment, or the like, through the forward portion 18 which is in communication with the slot 20. For purposes of simplicity, the airfoil 10 of the drawing is shown to be completely hollow in the forward portion 18, with no inserts being disposed within the cavity 16. Also, although none are shown, there may be passages through the walls 12 and 14 over the span of the airfoil to provide film cooling over the outer surfaces of the airfoil, as is well known to those skilled in the art.

Figure 2:
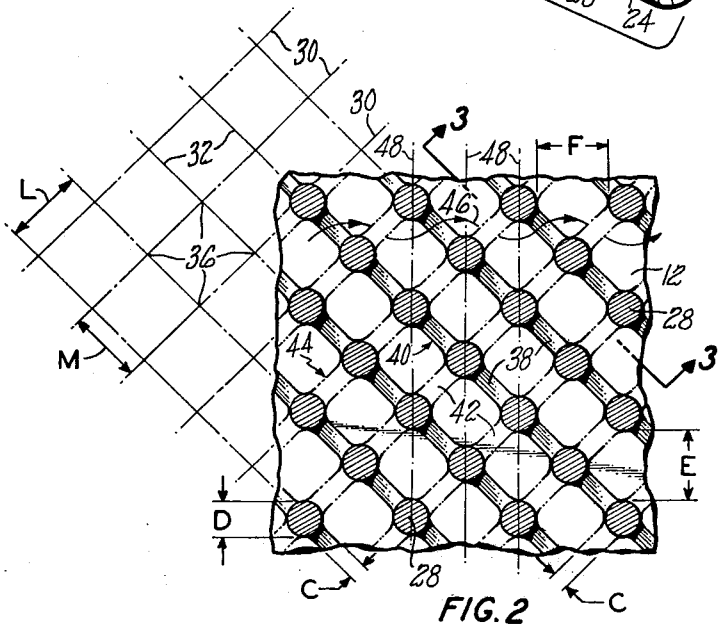
FIG. 2 is an enlarged cross-sectional view, partly illustrative, taken along the line 2—2 in FIG. 1.

Turning, now, to the trailing edge region 22, a plurality of cylindrical pedestals 28 having a diameter D extend across the slot 20 from the suction side wall 12 to the pressure side wall 14. Although cylinders are preferred, the pedestals could also have an oval, square, diamond, or other cross-sectional shape. Curved surfaces are best, however, since they minimize pressure drop. The pedestals are arranged in an array which is shown in FIG. 2. The array is best described with reference to a diamond pattern formed by two criss-crossing sets of parallel lines 30, 32. The first set of parallel lines 30 extend from the lower left to the upper right of the figure. A second set of parallel lines 32 extends from the lower right to the upper left and crosses the lines 30. The distance L between adjacent lines 32 is equal to the distance M between adjacent lines 30; and, therefore, the lines form a grid of congruent diamonds. (A square is considered a diamond for purposes of this application.) The lines 30, 32 are oriented such that a diagonal of each diamond is substantially parallel to the spanwise direction of the airfoil. In accordance with the present invention, a pedestal 28 is located at each vertex 36 defined by the grid. The distance between pedestals located on a spanwise diagonal is herein designated by the dimension E; while the distance between pedestals located on the other or downstream diagonal is designated by the dimension F.

Figure 3:
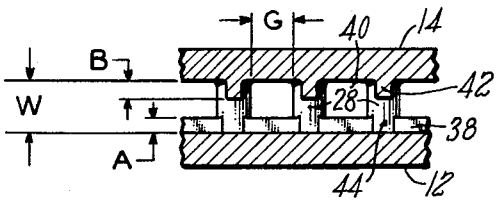
FIG. 3 is a cross-sectional view taken along the line 3—3 in FIG. 2.

As best shown in FIGS. 2 and 3, suction side fences 38 extend between and join adjacent pedestals 28 lying along each line 30. The suction side fences 38 are walls of length G and thickness C extending inwardly from the suction side wall 12 a distance A (i.e., fence height A) which is less than the width W of the slot 20. Any cooling fluid flowing along the suction side wall of the slot 20 which tries to pass between a pair of pedestals 28 joined by a suction side fence 38 will be forced to travel over the fence 38 through the opening 40 between the fence 38 and the pressure side wall 14.

In like fashion, adjacent pedestals 28 lying along the lines 32 of the grid are joined by pressure side fences 42, which are also walls of length G and thickness C extending inwardly from the pressure side wall 14 and having a height B less than the width W of the slot 20. Cooling fluid traveling along the pressure side wall 14 and attempting to pass between a pair of adjacent pedestals on one of the lines 32 will be forced to flow over this barrier or fence 42 through the opening 44 between the fence 42 and the suction side wall 12. Preferably the pressure and suction side fences are the same height, although this is not mandatory.

The object of the fences is to trip the thermal boundary layer; and, therefore, the fence heights A and B should be equal to or greater than the thermal boundary layer thickness, which will be from about 3 to 5 mils. A fence height of 5 to 10 mils is preferred, but it is preferable not to exceed half the slot width. Excess fence height creates undesirable pressure losses.

Figure 4:
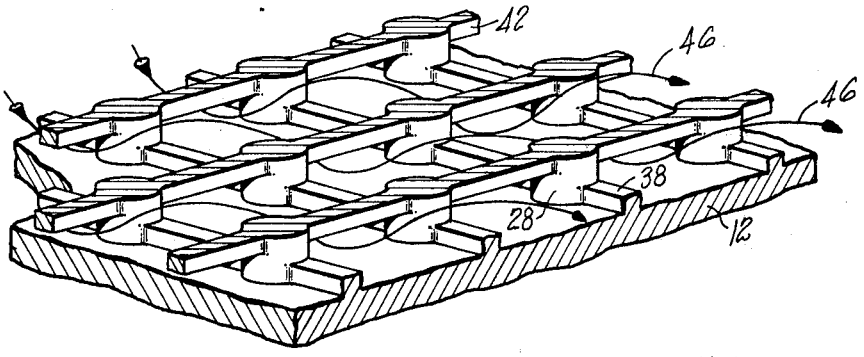
FIG. 4 is an illustrative perspective view of the pedestal and fence arrangement within the trailing edge region of the airfoil of FIG. 1 showing the movement of cooling fluid therethrough.

As a result of the foregoing configuration of pedestals and fences within the slot 20, cooling air flowing downstream through the slot 20 alternately passes over a suction side fence 38 and then a pressure side fence 42 while simultaneously passing around the pedestals 28. Thus the cooling air travels toward the trailing edge as a plurality of spirals or vortices having axes parallel to the downstream direction. Such spiral-like paths are superimposed on FIG. 2 as flow lines 46. The flow lines 46 are also shown in FIG. 4, which is an illustrative perspective view of the pedestal and fence arrangement within the slot 20.

The pedestals and fences add convective heat transfer surface area to the trailing edge region, while partially blocking the cooling air flow. The open spaces between pedestals through which the cooling air travels must be great enough to permit expansion of the air as it moves downstream. The spacing between pedestals is selected to assure that the cooling air "snakes" around the pedestals without excessive pressure losses while achieving an efficient rate of cooling. A measure of this spacing is the "pedastal density" which is the percentage of slot area blocked by the pedestals in a plane perpendicular to the downstream direction passing through a spanwise row 48 of pedestals. Pedestal density may be calculated using the following formula:

$$\text{Pedestal Density (\%)} = \frac{D}{D+E} \cdot 100$$

If the pedestal density is too low the air will be able to pass through the slot with little interference from the pedestals, and the desired spiral motion may not be achieved.

Figure 5:
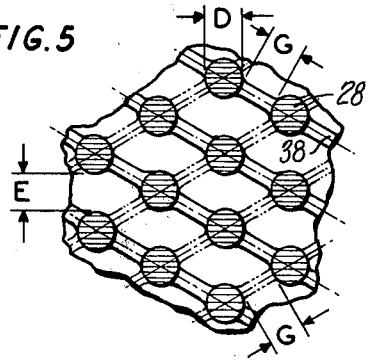
FIG. 5 is a cross-sectional view illustrating an alternate pedestal array according to the present invention.

For these reasons it is preferred that the pedestal density be between 35% and 50%, with 50% being most preferred. A 35% density is achieved when the dimension E equals the dimension F (i.e., the diamonds are squares) and the distance G between adjacent pedestals on the same line 30 or 32 is equal to the diameter D of the pedestal. A 50% density is achieved when the dimension E equals the diameter D. This latter case is shown schematically in FIG. 5.

Several configurations have been tested. These are described in the table below. In each case the slot width W was 0.020 inch.

TABLE 1

| Configuration No. | Dimension | | | | | | | |
|---|---|---|---|---|---|---|---|---|
| | A | B | C | D | E | F | G | Pedestal Density |
| 1 | 0.005 | 0.005 | 0.005 | 0.03 | 0.055 | 0.055 | 0.03 | 35% |
| 2 | 0.01 | 0.01 | 0.01 | 0.05 | 0.12 | 0.12 | 0.07 | 29% |
| 3 | 0.005 | 0.005 | 0.005 | 0.03 | 0.03 | 0.06 | 0.03 | 50% |

All three configurations performed better than the prior art; however, configuration No. 2 had a higher pressure drop than the other configurations due to the high fence height and low heat transfer rate as a result of a pedestal density believed to be too low. For these reasons it was not as satisfactory as the other two configurations. Configuration No. 3 gave best results in terms of a good balance between pressure drop and heat transfer performance.

The airfoil of the foregoing embodiment may be a two-piece airfoil comprising a suction side piece and a pressure side piece. The trailing edge region of the suction side piece comprises pedestals having a height only half the width of the slot and which are joined by the suction side fences. The pressure side piece comprises the corresponding halves of the pedestals as well as the pressure side fences which connect these pedestal halves. The pedestals and fences for each half may be formed by electrodischarge machining using a template of the appropriate configuration, or by casting.

The airfoil according to the present invention could also be cast as a single piece or may be made from radial wafers. If made from radial wafers, the forward portion of the airfoil would comprise radial wafers having parallel bond planes which are at an angle to the airfoil centerline; and the trailing edge region would be formed from two radial wafers, one for the suction side and the other for the pressure side, similar to a two-piece bonded airfoil. These trailing edge region halves would be bonded to the downstream-most radial wafer of the forward portion and to each other, such as by diffusion or transient liquid phase bonding.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. An airfoil having a suction side wall and a pressure side wall defining a forward portion of said airfoil and a trailing edge region of said airfoil, said trailing edge region including a trailing edge, said suction side wall and said pressure side wall being spaced apart defining a cooling air cavity within said forward portion and a slot of width W in said trailing edge region, said slot being in communication with said cavity for receiving cooling air from said cavity, said airfoil including means defining outlet passageways through said trailing edge in communication with said slot for discharging cooling air from said slot through said trailing edge;

a plurality of spaced apart pedestals extending across said slot from said pressure side wall to said suction side wall, said pedestals being arranged in an array wherein they are located at each vortex formed by two criss-crossing sets of parallel lines, the distance between adjacent parallel lines in both sets being equivalent to define a grid of congruent diamonds, said sets of parallel lines being angled relative to each other such that a line connecting a first pair of opposing vertices of each diamond is substantially parallel to the spanwise direction of the airfoil;

a plurality of suction side fences joining each pair of adjacent pedestals along each of the lines of one of said two sets of criss-crossing parallel lines, wherein each suction side fence is a wall of length G and of height A extending inwardly from said suction side wall, said height A being less than the slot width W; and a plurality of pressure side fences joining each pair of adjacent pedestals along each of the lines of said other of said two sets of criss-crossing parallel lines, wherein each pressure side fence is a wall of height B extending inwardly from said pressure side wall, said height B being less than the slot width W.

2. The airfoil according to claim 1 wherein the height A is greater than or equal to the thickness of the thermal boundary layer along the suction side of said slot, and the height B is greater than or equal to the thickness of the thermal boundary layer along the pressure side of said slot.

3. The airfoil according to claim 2 wherein the height A equals the height B and neither height is greater than half the slot width W.

4. The airfoil according to claims 1, 2 or 3 wherein said pedestals are cylinders of diameters D, said pedestal density is about 50%, and the distance G is approximately equal to the diameter D.

5. The airfoil according to claim 2 wherein the pedestal density is between about 35% and 50%.

6. The airfoil according to claim 5 wherein said grid of congruent diamonds is a grid of congruent squares.

7. The airfoil according to claim 6 wherein said pedestals are cylinders of diameter D, and the distance G is approximately equal to the diameter D.

8. The airfoil according to claims 1, 2 or 5 wherein said pedestals are cylinders of diameter D.

* * * * *